US007225480B2

(12) United States Patent
Mascheroni

(10) Patent No.: US 7,225,480 B2
(45) Date of Patent: Jun. 5, 2007

(54) SHOWER TRAY AND BOOTH MODULAR CONSTRUCTION

(75) Inventor: Luigi Mascheroni, Mestrino Padova (IT)

(73) Assignee: Megius S.p.A., Mestrino-Padova (IT)

( * ) Notice: Subject to any disclaimer, the term of this patent is extended or adjusted under 35 U.S.C. 154(b) by 289 days.

(21) Appl. No.: 10/936,058

(22) Filed: Sep. 7, 2004

(65) Prior Publication Data

US 2005/0050628 A1 Mar. 10, 2005

(30) Foreign Application Priority Data

Sep. 8, 2003 (IT) ..... MI2003A1724

(51) Int. Cl.
*A47K 3/22* (2006.01)

(52) U.S. Cl. ..... 4/613; 4/612; 4/614

(58) Field of Classification Search ..... 4/612–614, 4/596, 900, 663; 52/264
See application file for complete search history.

(56) References Cited

U.S. PATENT DOCUMENTS

| | | | | |
|---|---|---|---|---|
| 2,648,409 | A * | 8/1953 | Daugherty et al. | 52/264 |
| 3,501,879 | A * | 3/1970 | Roach et al. | 4/612 |
| 4,152,789 | A * | 5/1979 | Heath | 4/614 |
| 4,291,423 | A * | 9/1981 | Wilson | 4/612 |
| 4,539,721 | A * | 9/1985 | Moore | 4/613 |
| 4,890,426 | A * | 1/1990 | Hickman et al. | 52/58 |
| 4,993,201 | A * | 2/1991 | Bunyard | 4/614 |
| 5,092,002 | A * | 3/1992 | Powers | 4/613 |
| 6,698,037 | B2 * | 3/2004 | Lippe | 4/612 |
| 6,941,703 | B2 * | 9/2005 | MacLean et al. | 4/613 |

* cited by examiner

*Primary Examiner*—Khoa D. Huynh
(74) *Attorney, Agent, or Firm*—Hedman & Costigan P.C.; James V. Costigan

(57) ABSTRACT

A shower tray and booth modular construction comprises a bottom including a plate-like body, associated with a frame, to form the water collection tray, the plate-like body being extruded from a plastics material and then so bent as to engage its side edges in section member lengths constituting the frame.

4 Claims, 9 Drawing Sheets

SHOWER TRAY AND BOOTH MODULAR CONSTRUCTION

BACKGROUND OF THE INVENTION

The present invention relates to a shower tray and booth modular construction.

As is known, shower booth assemblies conventionally comprise a bottom, made of a plastics or ceramic material, operating as a tray for collecting water, as a supporting surface for supporting the shower user, and as glass or plastic encompassing walls.

Also known is the fact that shower booth assemblies are conventionally made in standard size, in particular with respect to the tray size.

Thus, the selection of a shower tray and booth construction is necessarily limited, which would hinder a free designing of a bath room.

SUMMARY OF THE INVENTION

Accordingly, the aim of the present invention is to provide such a shower tray and booth construction overcoming the above mentioned drawbacks affecting the prior art.

Within the above mentioned aim, a main object of the present invention is to provide such a shower tray and booth construction having a modular arrangement, thereby it can be easily sized depending on the specific use requirements.

Another object of the present invention is to provide such a shower tray and booth construction, which can be easily and quickly made and installed.

Another object of the present invention is to provide such a shower tray and booth construction which is very reliable from an operating and reliability standpoint.

Yet another object of the present invention is to provide such a shower tray and booth construction which can be easily made, at a competitive cost, and starting from easily available materials and systems.

According to one aspect of the present invention, the above mentioned aim and objects, as well as yet other objects, which will become more apparent hereinafter, are achieved by a shower tray and booth modular construction, characterized in that said construction comprises a bottom including a plate body associated with a frame to provide a water collecting tray, said plate body being extruded from a plastics material and then bent to allow side edges thereof to be engaged in section member lengths forming said frame.

BRIEF DESCRIPTION OF THE DRAWINGS

Further characteristics and advantages of the present invention will become more apparent hereinafter from the following detailed disclosure of a preferred, though not exclusive, embodiment of the invention, which is illustrated, by way of an indicative, but not limitative, example, in the accompanying drawings, where.

DESCRIPTION OF THE PREFERRED EMBODIMENT

Figure 1:
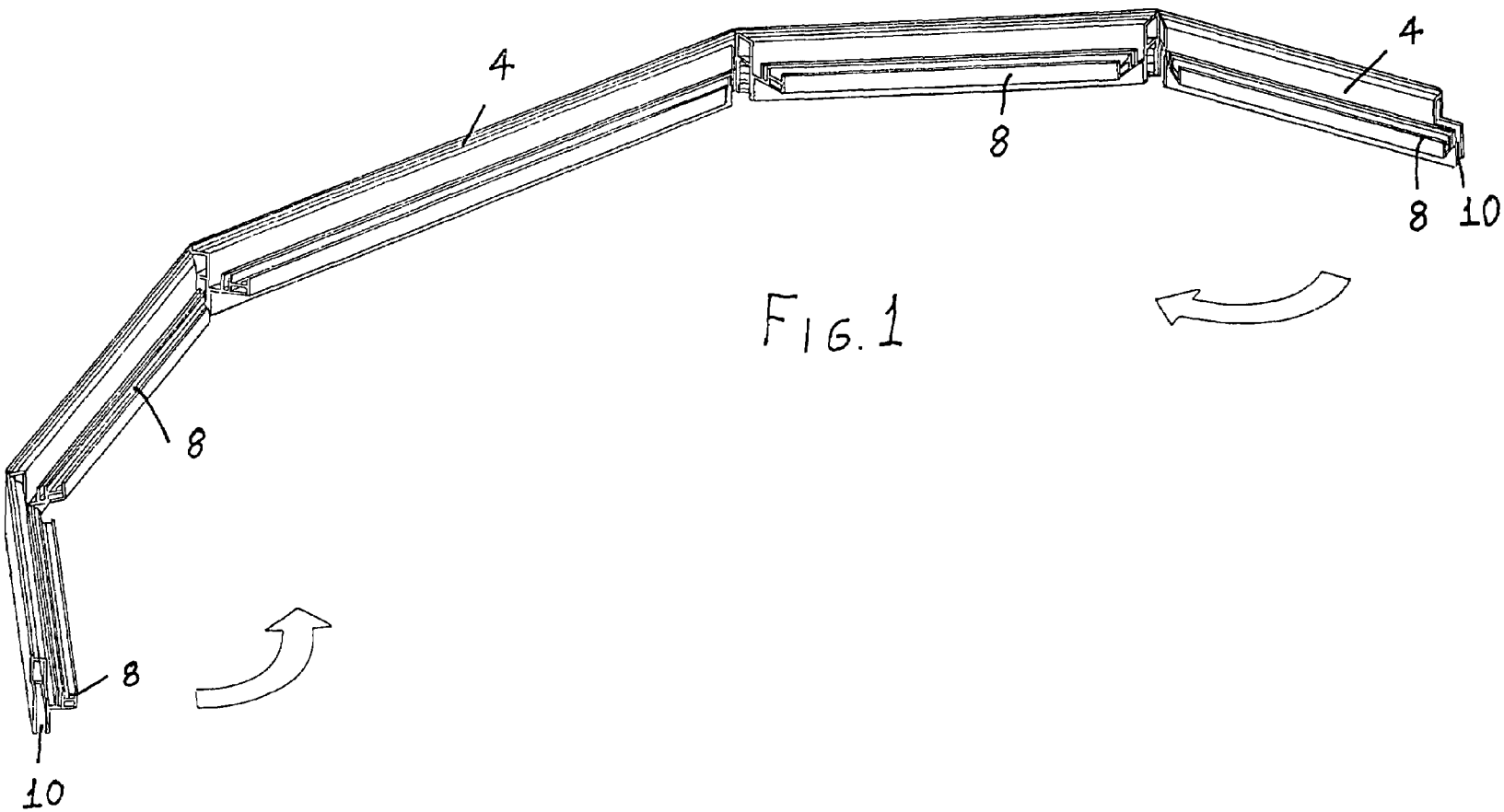
FIG. 1 is a perspective view, reversed with respect to the installation condition of the section member frame, and provided for forming the frame of the shower tray, according to the invention.
Figure 2:
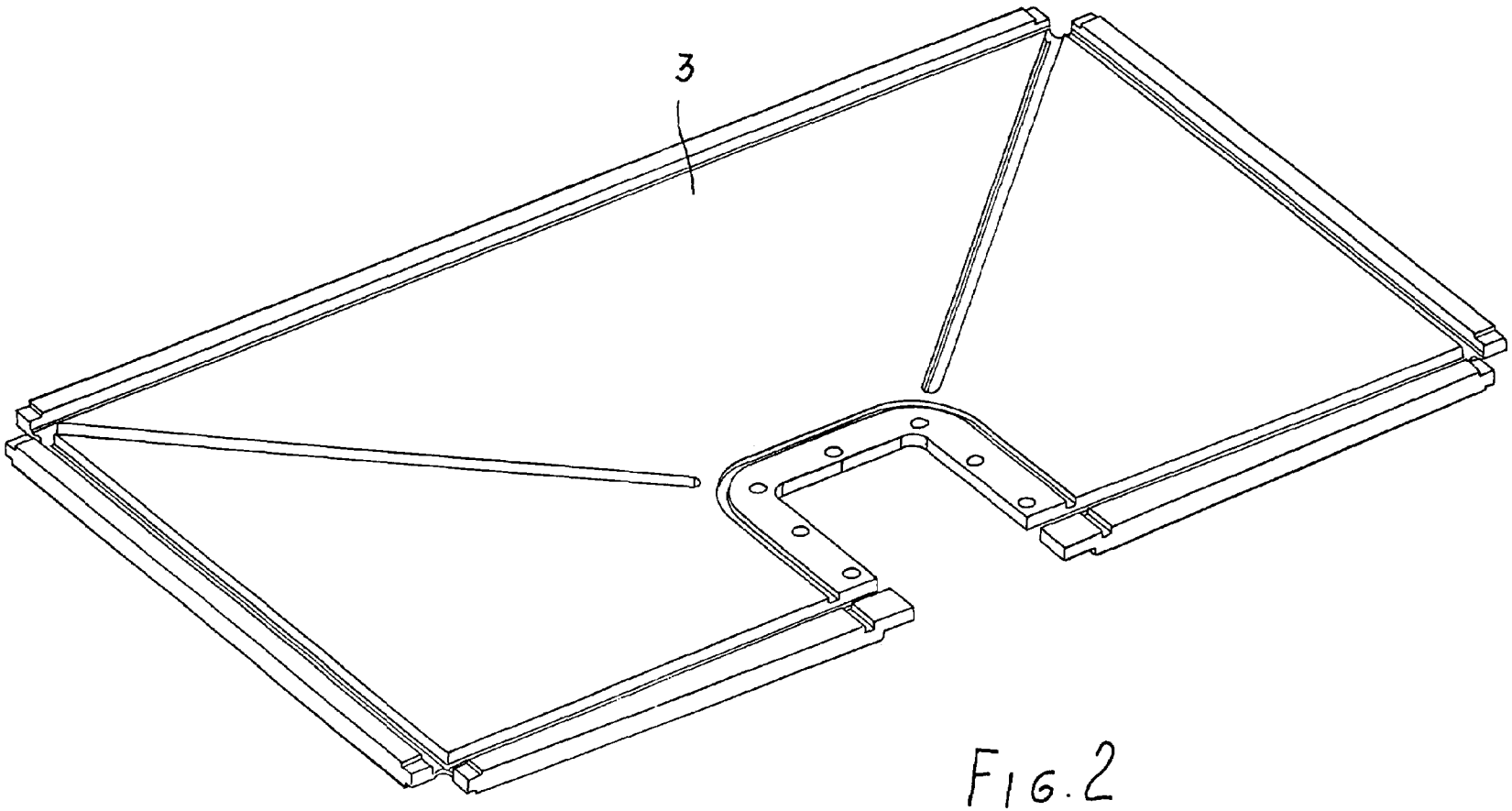
FIG. 2 is a further perspective view, in a reversed direction, of the shower tray, shown before a hot bending operation for hot bending an edge thereof.
Figure 3:
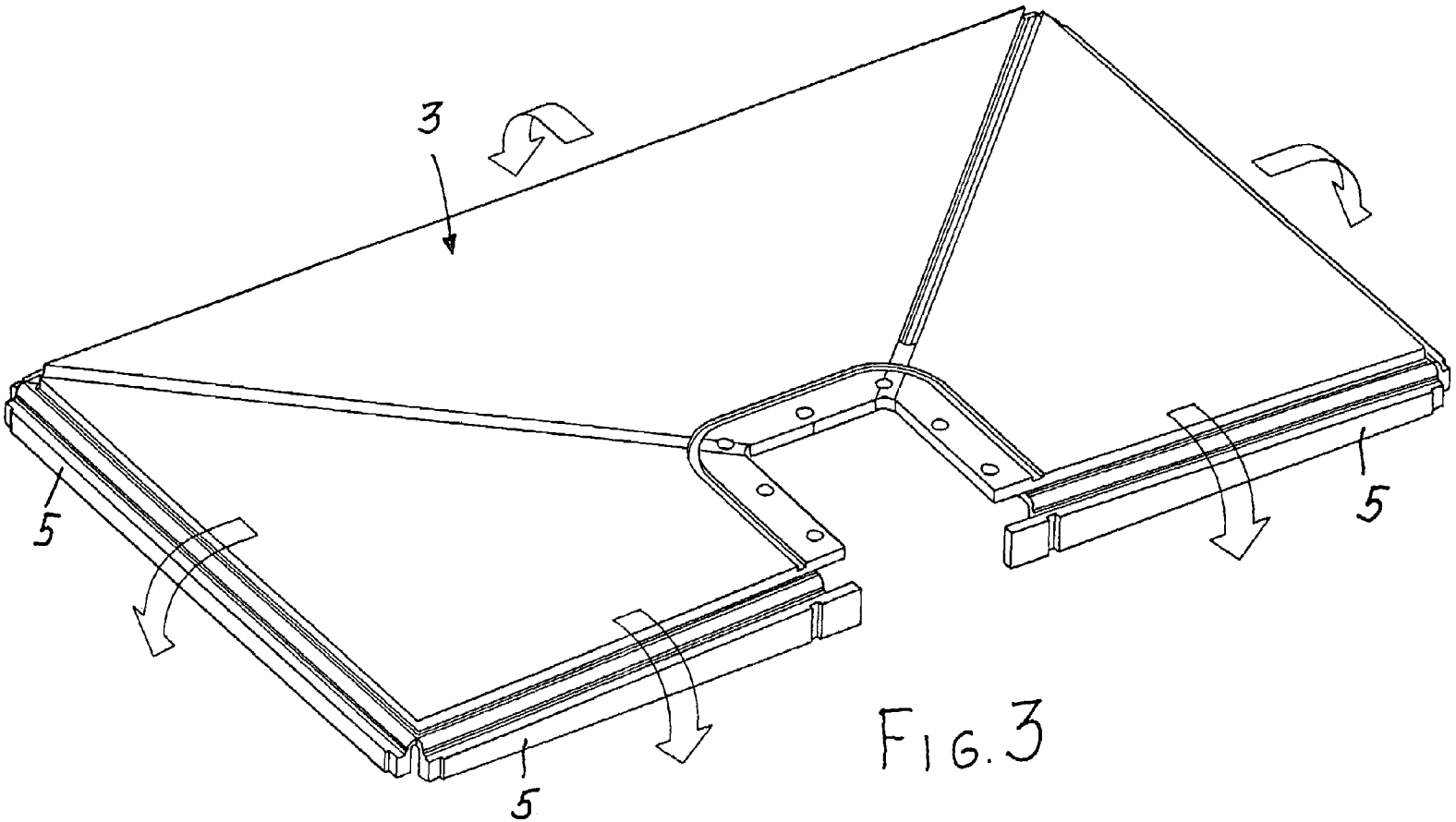
FIG. 3 is a further perspective view, similar to the preceding view, but illustrating the shower tray after having bent the edge thereof.
Figure 4:
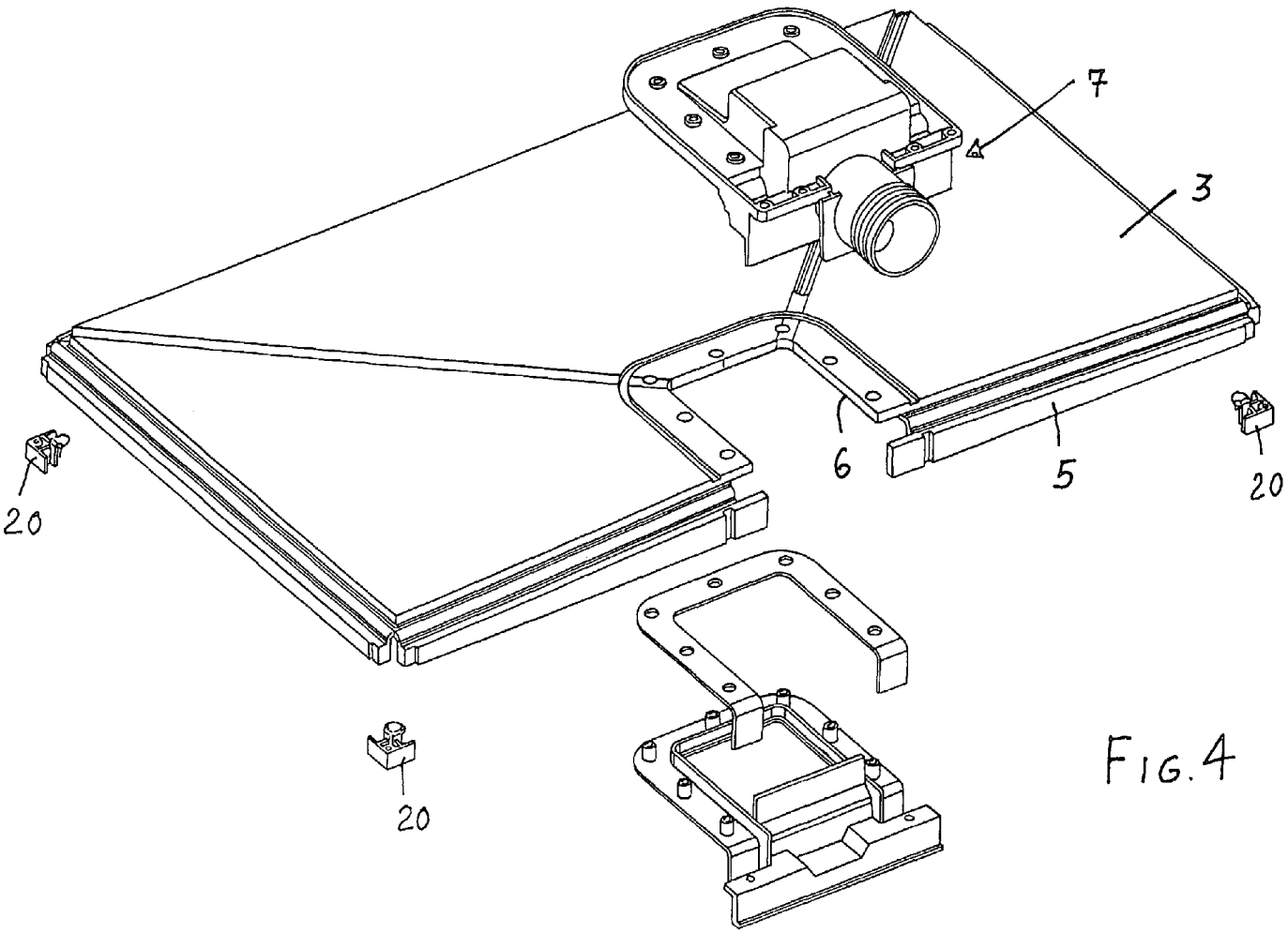
FIG. 4 is an exploded view of the shower tray and some components thereof, being shown in a reversed position from the installation position thereof.

With reference to the number references of the above mentioned figures, the shower tray and booth construction according to the present invention, which has been generally indicated by plate-like body 3 associated with a supporting frame to provide a water collecting tray or basin More specifically, said plate-like body 3 is preferably formed from foamed PVC, plate extruded PVC, and so on, the side edges 5 of which are successively hot bent, at a temperature of about 80° C., by way of an example, for engagement in the component elements of the supporting frame, formed by extruded section members 4.

As, shown, the plate-like body 3 is provided with a side cut-out recessed portion 6, offset from the center of the plate-like body and at which a drain assembly, generally indicated by the reference number 7, will be arranged said cut-out portion having substantially a horseshoe cross-section with a plurality of throughgoing holes arranged spaced from one another along the horseshoe contour.

The cut-out portion 6 is formed at a less height than the edges of the plate-like body, thereby providing an easy draining of water.

In particular, the section members 4 have an inner edge 8, which is open at the bottom threreof to allow the side edges 5 to be engaged in the plate-like body, as disclosed, and which, at the top thereof, define a bearing surface for a plurality of elements 9, in the form of staves, which, as they are arranged in an adjoining parallel relationship, will provides a user supporting surface or shower bottom 2.

Said section members 4 are moreover provided with a longitudinal recess 10 designed for receiving a panel 11 forming the shower bath wall.

Figure 5:
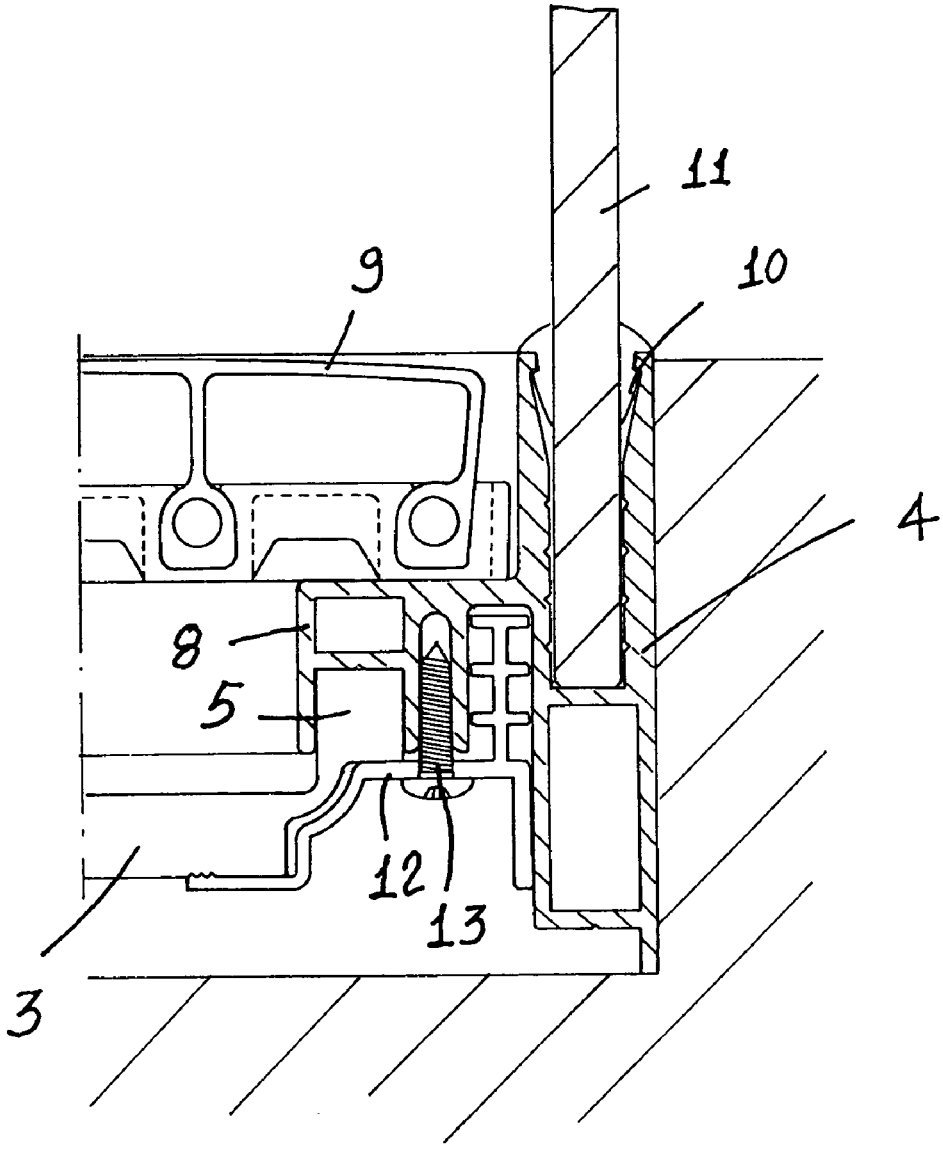
FIG. 5 is an elevation cross-sectioned view, showing the shower tray in an assembled condition thereof.
Figure 6:
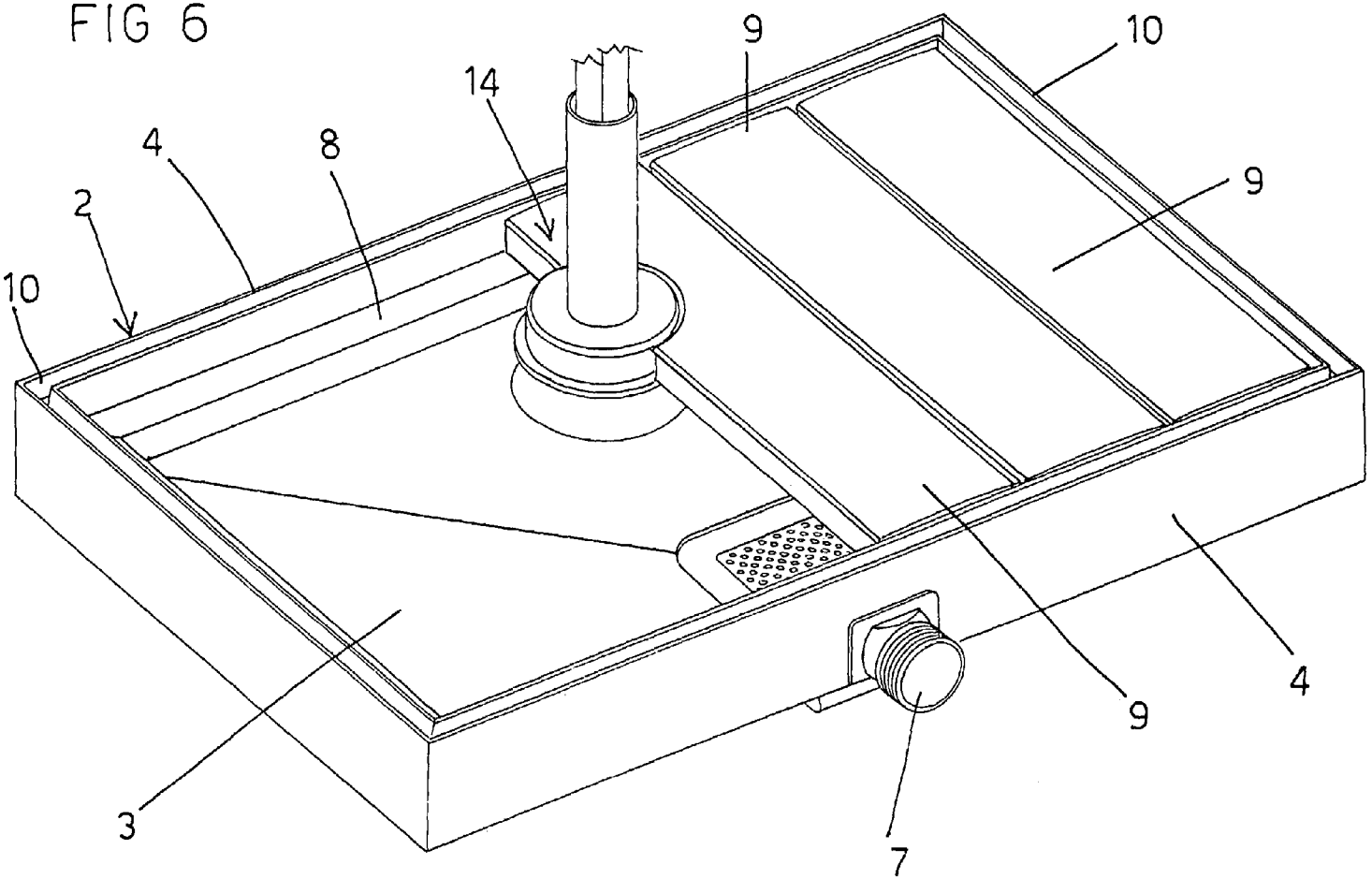
FIG. 6 is a further perspective view of the shower tray in a partially assembled condition thereof.
Figure 7:
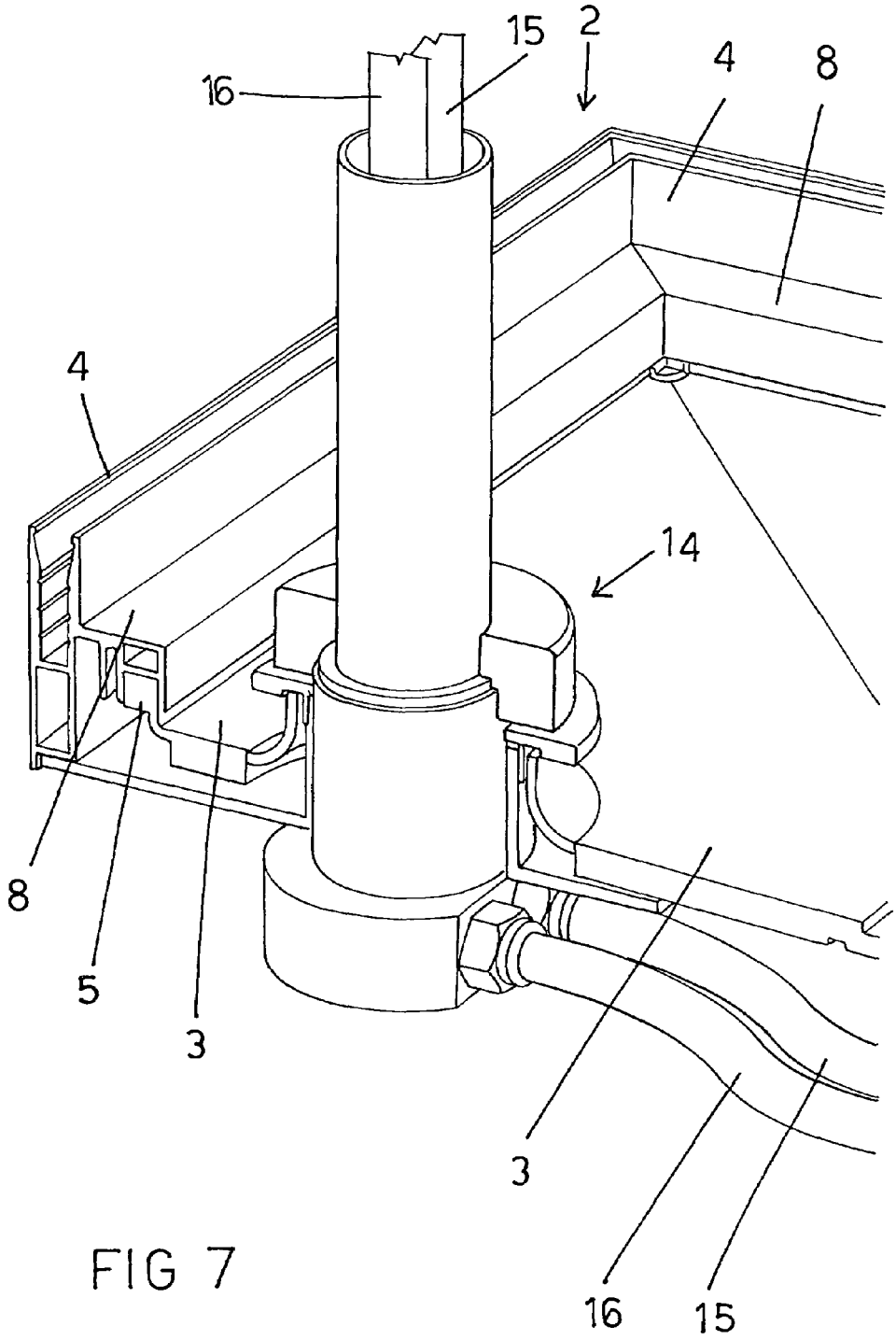
FIG. 7 is a further perspective view, on an enlarged scale, showing the attachment region of a water supplying column assembly.
Figure 8:
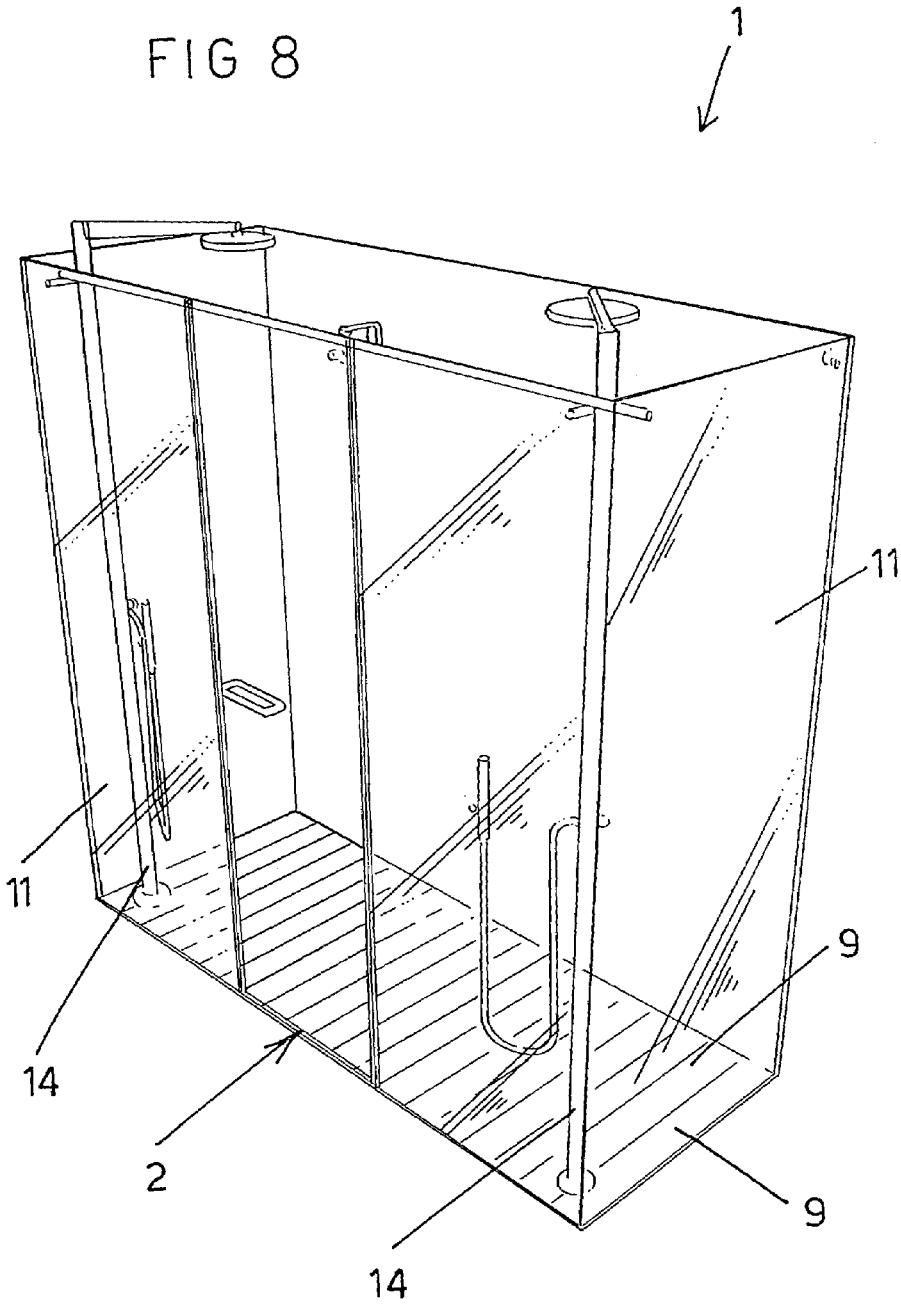
FIG. 8 is a front perspective view of a shower booth according to the present invention.
Figure 9:
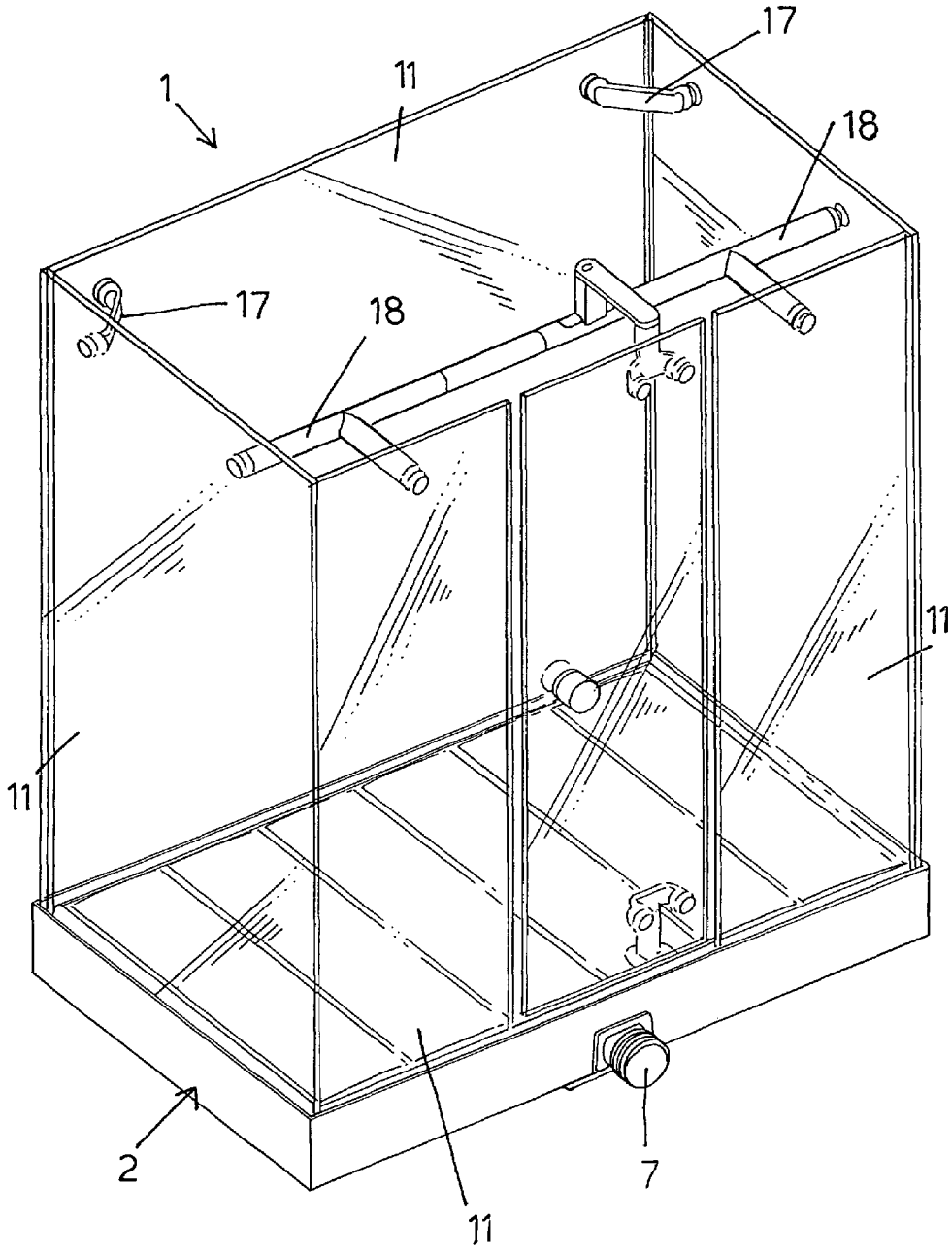
FIG. 9 is a further rear perspective view of a shower booth construction according to another aspect of the present invention.

Moreover, said plate-like body 3 is locked in its desired position by locking section members 12 which are clamped, by clamping screws 13, to the inner edges 8 of the section members 4, to clamp or lock at a desired position the side edges 5 of the plate-like body, as clearly shown in FIG. 5.

The plate-like body 3 can be moreover provided with a hole for allowing a water supplying column, generally indicated by the reference number 14 to pass therethrough, said column holding the hot and cold water delivery tubes 15 and 16, respectively.

Said panels 11 can be mutually coupled by coupling brackets of any desired shape and size, and generally indicated in the drawings by the reference 17 and 18.

The shower tray according to the present invention comprises moreover angle elements 20, which are applied at the corners of the shower tray.

It has been found that the invention fully achieves the intended aim and objects.

In fact, the invention provides a shower tray and booth construction including a bottom which can be sized according to specific requirements, and which can be quickly and easily assembled.

Actually, the plate-like body 3 can be made with several sizes, both in a cross direction and in a longitudinal direction.

In particular, the section members 4 can be cut in lengths if any desired size, depending on the size of the plate-like body 3 sides, thereby allowing to provide a shower bottom 2 having any desired dimensions, depending on the specific use requirements.

Moreover, the tray and booth construction according to the present invention, and in particular the bottom thereof, can be made, as stated, with a lot of dimensions different from the standard size of prior tray and booth constructions, but, however, with a cost which can be advantageously compared with that of prior standard shower booth assemblies.

Another advantage of the invention is that it can be assembled and installed in a very quick and easy manner, by using available tools and assembling instruments.

In practicing the invention, the used materials, as well as the contingent size and shapes, can be any, depending on the specific use requirements.

The invention claimed is:

1. A shower tray and booth modular construction, comprising a bottom including a plastic material extruded plate body associated with a frame to provide a water collecting tray, said plate body having bent side edges formed by extrusion and engaged in section lengths forming said frame, wherein said plate body comprises a complete side cut-out portion at one of said bent side edges for engaging therein a drain assembly, and a plurality of section members, wherein said plurality of section members comprise each an inner edge which is open at the bottom thereof to allow said bent side edges of said plate body to be engaged therein and wherein the top of said inner edge of each of said section members defines a bearing surface which bears a plurality of adjoining parallel stave elements providing an user supporting shower bottom.

2. A construction, according to claim 1, wherein each said section member comprises a longitudinally extending recess for receiving a panel forming a wall of said shower booth assembly, and wherein said construction further comprises clamping section members for clamping said plate body at side edges thereof.

3. A construction, according to claim 1, wherein said construction further comprises angle elements to be applied at corner portions of said shower tray.

4. A construction, according to claim 1, wherein said cut-out portion has a substantially horseshoe cross-section with a horseshoe contour therethrough a plurality of mutually spaced throughgoing holes are formed.

* * * * *